US010539047B2

(12) United States Patent
Kameda et al.

(10) Patent No.: US 10,539,047 B2
(45) Date of Patent: Jan. 21, 2020

(54) ACTING FORCE TRANSMISSION DEVICE FOR USE WITH VALVE MECHANISM AND METHOD OF MANUFACTURING THE SAME

(71) Applicant: Eaton Corporation, Cleveland, OH (US)

(72) Inventors: Michihiro Kameda, Hadano (JP); Takatoshi Kimori, Hadano (JP)

(73) Assignee: Eaton Corporation, Cleveland, OH (US)

( * ) Notice: Subject to any disclaimer, the term of this patent is extended or adjusted under 35 U.S.C. 154(b) by 79 days.

(21) Appl. No.: 15/837,372

(22) Filed: Dec. 11, 2017

(65) Prior Publication Data

US 2018/0100412 A1 Apr. 12, 2018

Related U.S. Application Data

(63) Continuation of application No. PCT/US2016/036975, filed on Jun. 10, 2016.

(30) Foreign Application Priority Data

Jun. 11, 2015 (JP) ..... 2015-118460

(51) Int. Cl.
*F01L 1/18* (2006.01)

(52) U.S. Cl.
CPC ..... *F01L 1/185* (2013.01); *F01L 2103/00* (2013.01); *F01L 2105/02* (2013.01); *F01L 2810/02* (2013.01)

(58) Field of Classification Search
CPC .... F01L 1/185; F01L 2105/02; F01L 2810/02
(Continued)

(56) References Cited

U.S. PATENT DOCUMENTS 5,273,005 A * 12/1993 Philo ..... F01L 1/14 123/90.5
7,614,374 B2 * 11/2009 Watanabe ..... F01L 1/181 123/90.39

(Continued)

FOREIGN PATENT DOCUMENTS

DE 102007018686 A1 10/2008
DE 102013212076 A1 1/2015

(Continued)

OTHER PUBLICATIONS

International Search Report and Written Opinion for International Application No. PCT/US2016/036975 dated Aug. 24, 2016, 13 pages.

(Continued)

*Primary Examiner* — Ching Chang
(74) *Attorney, Agent, or Firm* — RMCK Law Group PLC

(57) ABSTRACT

An acting force transmission device for use with a valve mechanism of an engine includes an acting force transmission member that transmits an acting force to a valve to open/close the valve. A support shaft is provided in the acting force transmission member. An annular roller is directly mounted on an outer periphery of the support shaft. The roller is adapted to rotate when subjected to a cam force exerted by a cam and is adapted to transmit the cam force to the acting force transmission member as the acting force. A ratio d/D of an inner diameter d to an outer diameter D of the annular roller is not less than 0.7.

18 Claims, 12 Drawing Sheets

(58) Field of Classification Search
USPC ..... 123/90.39, 90.44
See application file for complete search history.

(56) References Cited

U.S. PATENT DOCUMENTS

| | | | |
|---|---|---|---|
| 2006/0210207 | A1 | 9/2006 | Umeda et al. |
| 2007/0047856 | A1 | 3/2007 | Piraner et al. |
| 2013/0133621 | A1 | 5/2013 | Jones et al. |
| 2014/0261269 | A1 | 9/2014 | Smith et al. |

FOREIGN PATENT DOCUMENTS

| | | | |
|---|---|---|---|
| EP | 0615056 | A1 | 9/1994 |
| FR | 2998614 | A1 | 5/2014 |
| FR | 2998629 | A1 | 5/2014 |
| GB | 2326694 | A | 12/1998 |
| JP | 2003112225 | A | 4/2003 |
| JP | 2003343216 | A | 12/2003 |
| JP | 2006118399 | A | 5/2006 |
| WO | 2008005384 | A2 | 1/2008 |

OTHER PUBLICATIONS

European Search Report for EP Application No. 16808417.6 dated Feb. 1, 2019, 9 pages.

* cited by examiner

ACTING FORCE TRANSMISSION DEVICE FOR USE WITH VALVE MECHANISM AND METHOD OF MANUFACTURING THE SAME

CROSS-REFERENCE TO RELATED APPLICATIONS

This application is a continuation of International Application No. PCT/US2016/036975 filed Jun. 10, 2016, which claims the benefit of Japanese Patent Application No. 2015-118460 filed on Jun. 11, 2015. The disclosure of the above application is incorporated herein by reference.

FIELD

This disclosure relates to an acting force transmission device for use with valve mechanism and method of manufacturing the same.

BACKGROUND

In one prior art example, a typical rocker arm structure comprises: an arm for transmitting an acting force to one end thereof (said end hereinafter referred to as action transmitting end) adapted to transmit the action to a valve in order to open/close the valve; a support shaft projecting laterally from the arm at a position of the arm offset from said action transmitting end towards the other end of the arm. An annular roller rotatably mounted on a periphery of the support shaft via a rollable bearing equipped with needle bearings, the annular roller adapted to roll when subjected to a cam force that acts on an outer periphery of the roller and adapted to transmit the cam force to the action transmitting end as an acting force that acts on the valve.

With this rocker arm installed in a valve mechanism, the rocker arm structure can appropriately transmit the cam force to the valve mechanism with a reduced frictional loss of power owing to the needle bearings that reduce sliding friction between the cam and the rocker arm (or roller), thereby facilitating improvement in fuel efficiency and engine output.

However, since the above mentioned rocker arm structure involves needle bearings disposed between the support shaft and the roller, the shaft is subjected to the cam force via the needle bearings, which implies that the support shaft is subjected to a localized load. In order to avoid an excessive localized load from acting on the support shaft, the entire length of the needle bearings and the axial length of the roller are made larger than predetermined lengths so as to ensure desired contact areas for transmission of the cam force. The roller, therefore, cannot be shortened less than the predetermined axial lengths so long as needle bearings are employed.

SUMMARY

In view of such circumstance as stated above, an inventor of the present disclosure developed a rocker arm structure equipped with a roller that is directly mounted on the support shaft without needle bearings.

If this type of prior art rocker arm structure is installed in a valve mechanism configured for use under a condition that the valve mechanism is sprayed or showered with engine oil during its operation, engine oil is induced as a lubricant into spaces between the support shaft and the roller, spreading over the entire inner periphery of the rotating roller. Consequently, lubricant is then secured between the inner periphery of the roller and the outer periphery of the support shaft, enabling smooth relative rotations of the roller and the support shaft without any needle bearings.

On the other hand, while this rocker arm structure permits elimination of abutment of the support shaft against the needle bearings, the rocker arm allows the support shaft to bear thereon a roller having an exceedingly larger internal diameter than the needle bearings, hence allowing the support shaft to have an enlarged contact area abutting against the roller. Furthermore, since the roller and the support shaft rotate in the same direction and since their inner and outer peripheries have similar radii of curvatures, their peripheries experience less elastic deformations as they come into contact with each other under a cam force acting on the roller, as compared with a case where the support shaft is in contact with the needle bearings. Consequently, in the rocker arm structure above, the support shaft is positively prevented from being exposed to an excessively localized load.

A detailed analysis of the above mentioned rocker arm structure reveals that the magnitude of a cam torque applied to an inventive canonical rocker arm structure is small (as shown in a lower figure of FIG. 9 by a plot for a canonical rocker arm) as in a standard rocker arm structure supported by a support shaft via a rocker arm having needle bearings (as shown in a lower part of FIG. 9 by a plot for a standard rocker arm) when the rpm of the engine (or rpm of the cam) is in a very high rpm region. However, in a middle and low rpm domains of cam revolution (or of engine rpm), the cam torque is higher than that observed in the standard rocker arm structure equipped with needle bearings, as shown in FIG. 9). Consequently, in cases where the rocker arm structure mounted in a valve mechanism of an engine is in operation at a middle or a low rpm domain, its fuel economy becomes low below that of a standard rocker arm structure (having needle bearings).

In view of such problem as stated above, it is a first object of the disclosure to provide a rocker arm structure having a support shaft, directly yet rotatably supporting on the outer periphery thereof, an inner periphery of a roller such that the rocker arm structure transmits a cam torque in a manner similar to a rocker arm structure having needle bearings even when the engine rpm is in a middle and a row rpm domain.

It is a second object of the disclosure to provide a method of manufacturing such rocker arm structure as stated above. Further object of the disclosure is to resolve the issue of a friction coefficient of an acting force transmission device being increased to a degree more than that of a standard rocker arm (having needle bearings) in a low and a middle rpm domain (FIG. 10) from a different point of view.

An acting force transmitting device for use with a valve mechanism of an engine includes an acting force transmission member, a support shaft and an annular roller. The acting force transmission member is configured to transmit an acting force to a valve to open/close the valve. The support shaft is provided in the acting force transmission member. The annular roller is directly mounted on an outer periphery of the support shaft. The roller is adapted to rotate when subjected to a cam force exerted by a cam and adapted to transmit the cam force to the acting force transmission member as the acting force. A ratio d/D of an inner diameter d to an outer diameter D of the annular roller is not less than 0.7.

According to other features, the support shaft can be mounted on the acting force transmission member. The annular roller can comprise an inner periphery that opposes the outer periphery of the support shaft. Lubrication is realized between the inner periphery of the annular roller and the outer periphery of the support shaft near a domain of elastohydrodynamic lubrication. The lubrication is realized at an engine revolution per minute of 600 rpm. The ratio d/D can be 0.95.

A method of manufacturing an acting force transmission device for use with a valve mechanism of an engine includes an acting force transmission member for transmitting an acting force to a valve to open/close the valve. A support shaft is mounted on the acting force transmission member. An annular roller is directly mounted on an outer periphery of the support shaft and adapted to rotate when subjected to a cam force exerted by a cam and adapted to transmit the cam force to the acting force transmission member as the acting force. The method includes configuring the annular roller such that a ratio d/D of an inner diameter d to an outer diameter D of the roller is not less than 0.7. The method can further include directly and rotatably mounting the annular roller onto the support shaft.

A rocker arm structure for use with a valve mechanism of an engine and constructed in accordance to other features of the present disclosure includes an arm, a support shaft and an annular roller. The arm transmits an acting force to an action transmitting end thereof and is adapted to transmit the action to a valve in order to open/close the valve. The support shaft projects laterally from the arm at a position of the arm offset from the action transmitting end toward an opposite end of the arm. The annular roller is rotatably mounted on the outer periphery of the support shaft. The roller is rotated by a cam force exerted by a cam onto an outer periphery thereof to transmit the cam force to the support shaft so as to transmit the cam force to the action transmitting end via the arm. Contact stress P depends on a contact width (Wm). The sliding speed V depends on an inner diameter (DRin) of the roller. The contact width Wm of the outer periphery of the support shaft in contact with the inner periphery of the roller and the inner diameter (DRin) of the roller are configured such that a product PV remains in a domain of hydrodynamic lubrication even when an rpm of the engine is at an rpm less than a predetermined middle rpm level. P is a contact stress exerted by the inner periphery of the roller to the outer periphery of the support shaft in contact with the roller. V is a sliding speed V of the inner periphery of the roller relative to the outer periphery of the support shaft.

According to other features, the support shaft is mounted on the arm. The support shaft can be directly and rotatably mounted onto the arm. The annular roller comprises an inner periphery that opposes the outer periphery of the support shaft. Lubrication is realized between the inner periphery of the annular roller and the outer periphery of the support shaft near a domain of elastohydrodynamic lubrication.

A method of manufacturing a rocker arm structure that includes an arm, a support shaft and an annular roller according to additional features is provided. The arm transmits to one end thereof serving as an action transmitting end, an acting force that acts on a valve to open/close the valve. The support shaft projects laterally from the arm at a position offset from one end toward the other end of the arm. The annular roller is rotatably mounted on the outer periphery of the support shaft. The roller is rotated by a cam force exerted by a cam onto an outer periphery thereof to transmit the cam force to the support shaft so as to transmit the cam force to the action transmitting end via the arm. The method includes configuring a contact width (Wm) of the outer periphery of the support shaft in contact with the inner periphery of the roller and the inner diameter (DRin) of the roller such that a product PV remains in a domain of hydrodynamic lubrication even when an rpm of the engine is at an rpm less than a predetermined middle rpm level. P is a contact stress exerted by the inner periphery of the roller to the outer periphery of the support shaft in contact with the roller. V is a sliding speed of the inner periphery of the support shaft. The method includes directly and rotatably mounting the annular roller onto the support shaft.

According to the acting force transmission device for use with valve mechanism and method of manufacturing the same, it is possible to realize lubrication between the inner periphery of the roller and the outer periphery of the support shaft near a domain of elastohydrodynamic lubrication (EHL) even at a low rpm (600 rpm for example) so that the inventive acting force transmission device achieves nearly the same friction performance as a conventional device equipped with needle bearings even under a middle/low engine rpm domain.

BRIEF DESCRIPTION OF THE DRAWINGS

The present disclosure will become more fully understood from the detailed description and the accompanying drawings, wherein:

FIG. 9 also shows a relationship between engine rpm and lubrication mode of a canonical rocker arm structure.

DETAILED DESCRIPTION

Figure 1:
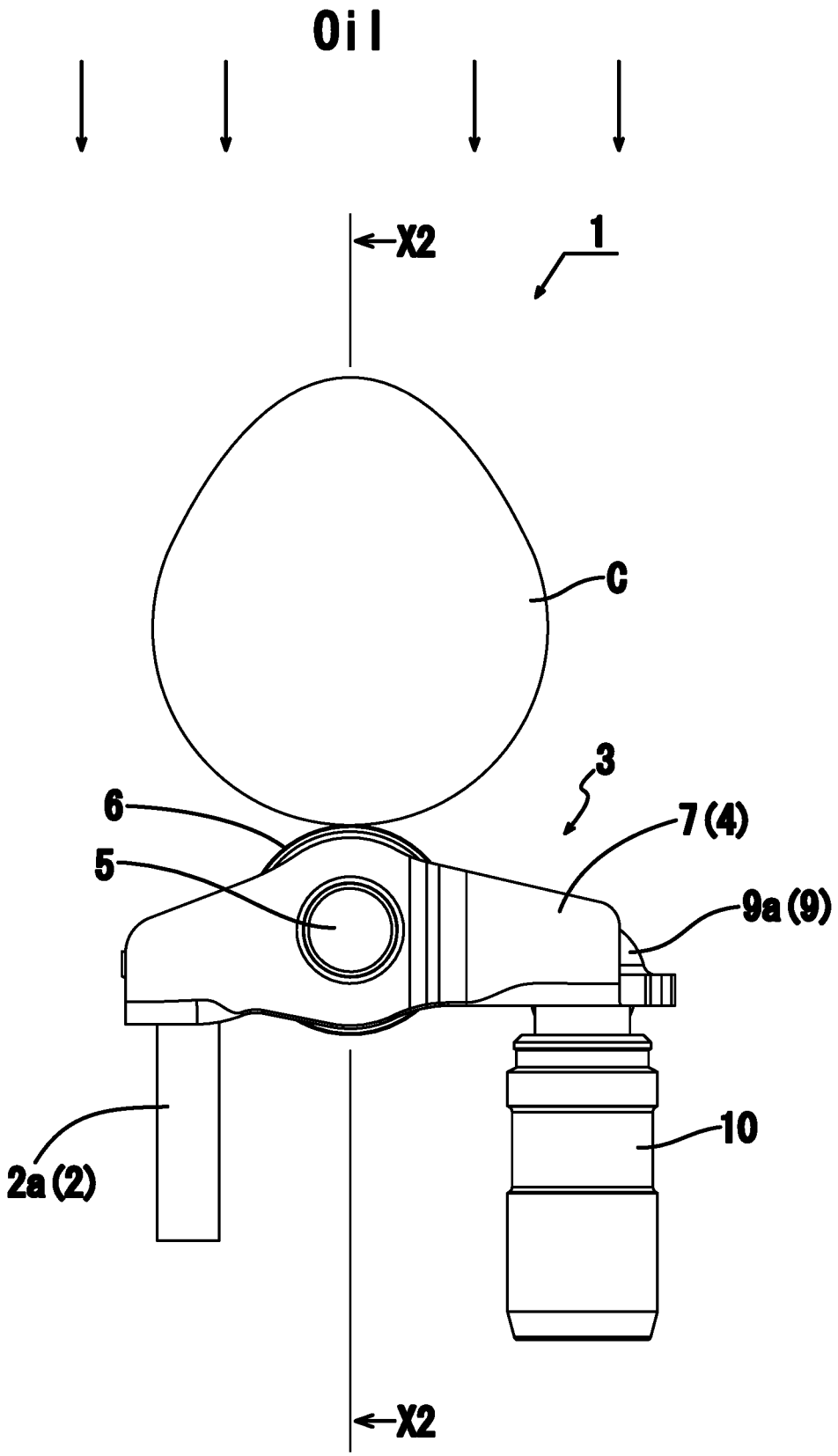
FIG. 1 shows a structure of a rocker arm in accord with the first example of the disclosure.
Figure 2:
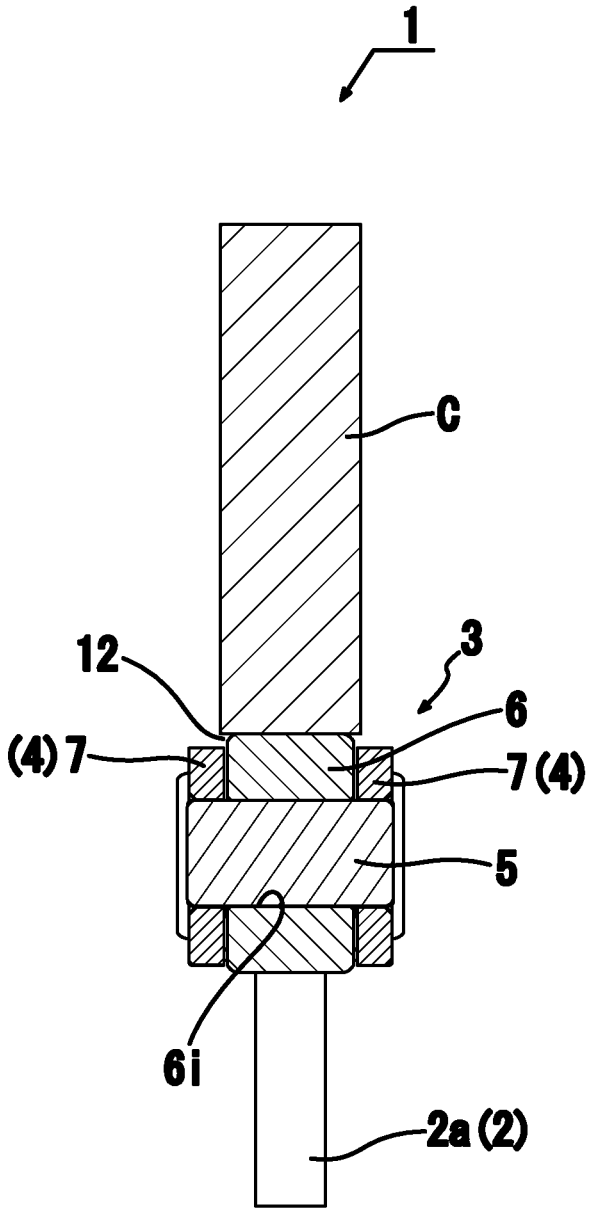
FIG. 2 is a cross section taken along line X2-X2 in FIG. 1.
Figure 3:
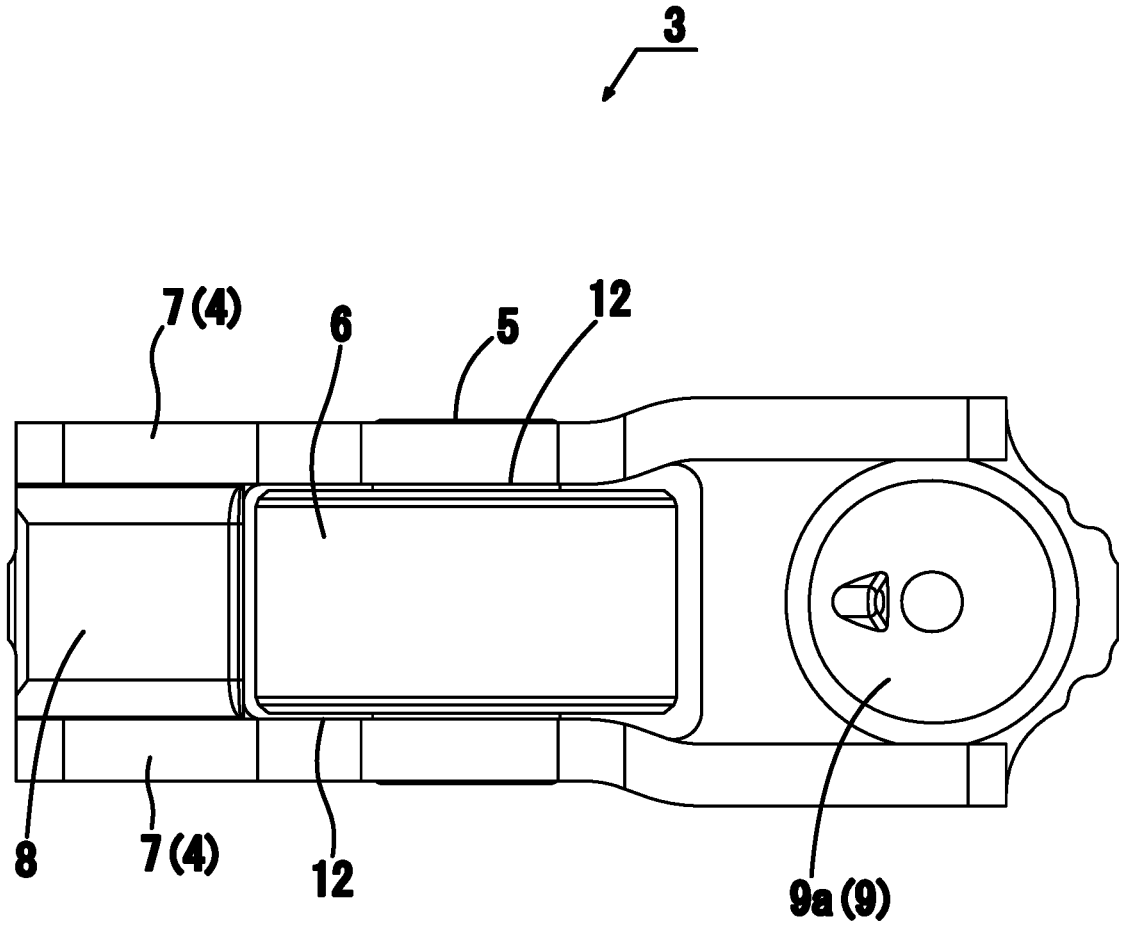
FIG. 3 is a plan view of a rocker arm in accord with the first example of the disclosure.
Figure 4:
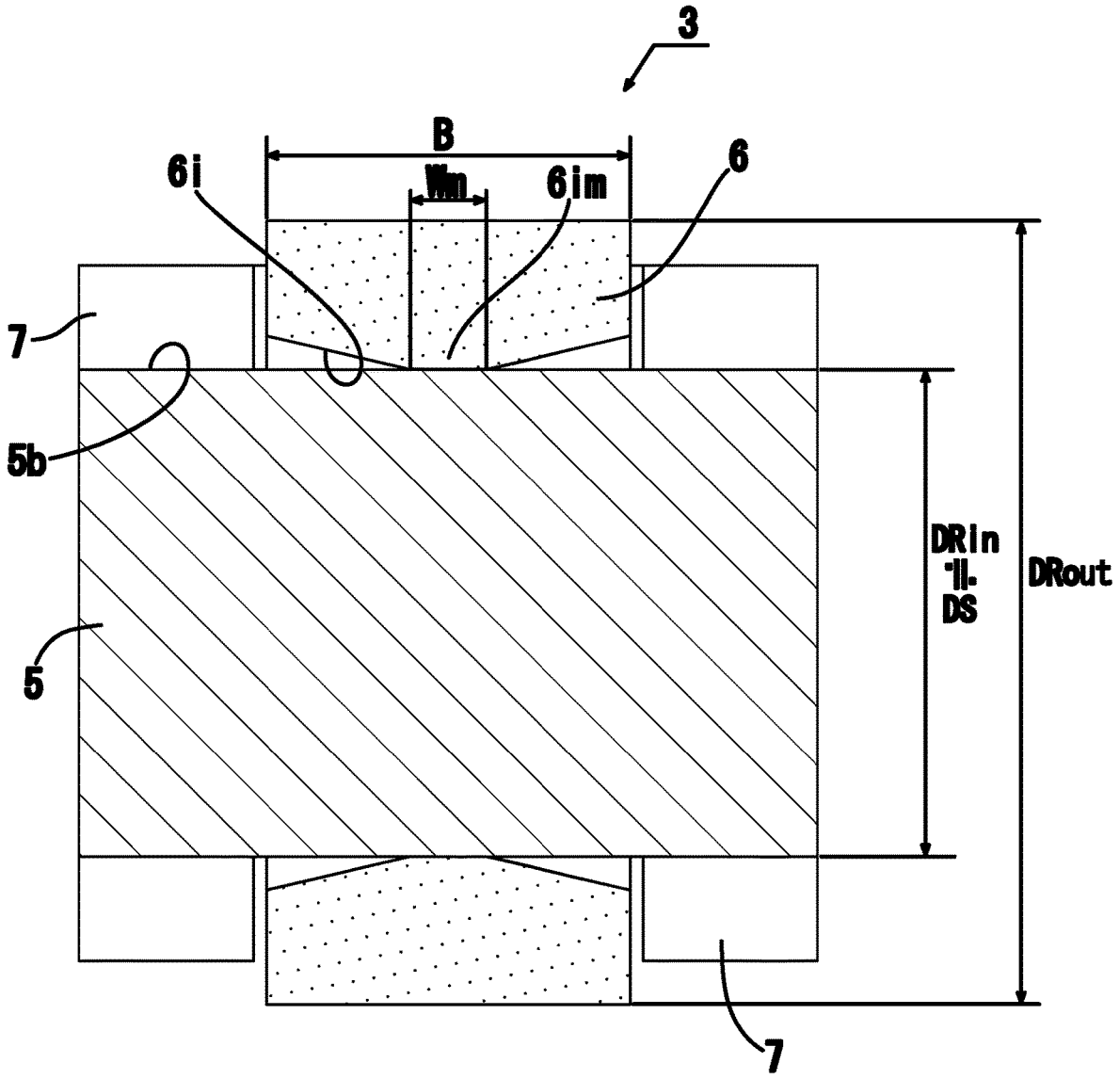
FIG. 4 is a brief longitudinal cross section of a rocker arm in accord with the first example of the disclosure.
Figure 5:
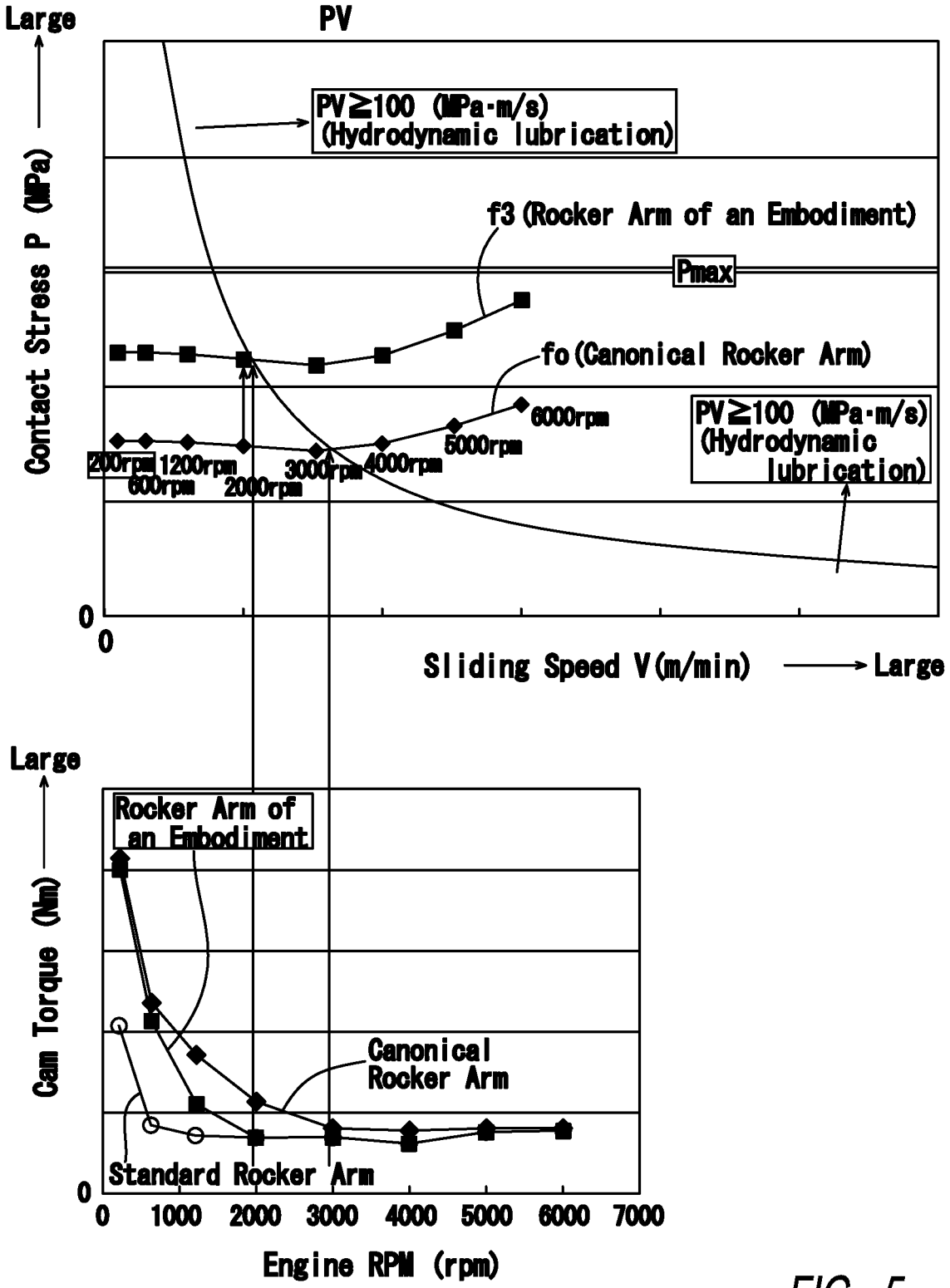
FIG. 5 illustrates a method of determining the inner diameter and the central contact width of the inner periphery of the roller.
Figure 6:
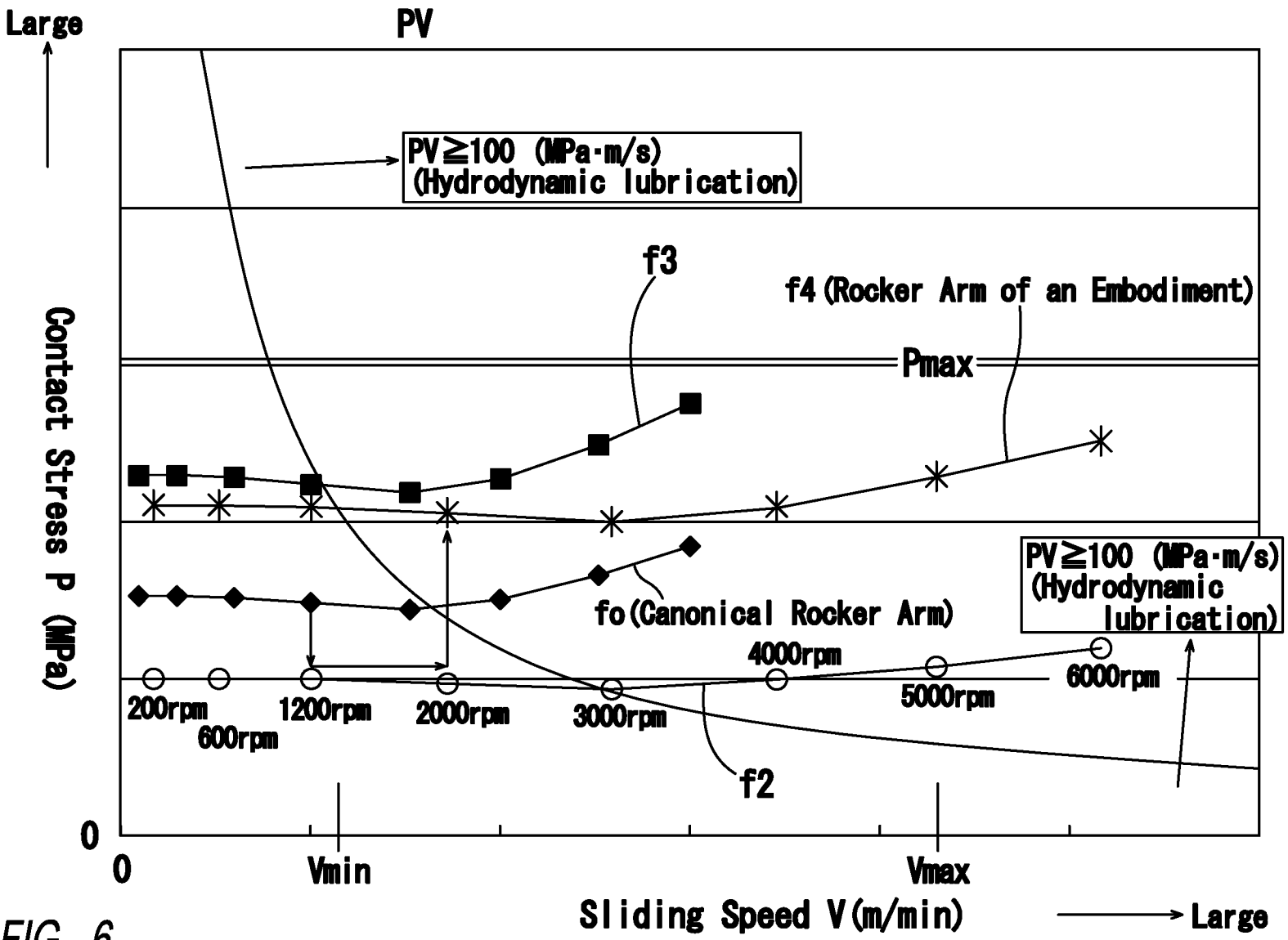
FIG. 6 illustrate alternative method of determining the inner diameter and the central width of the inner periphery of the roller.
Figure 7:
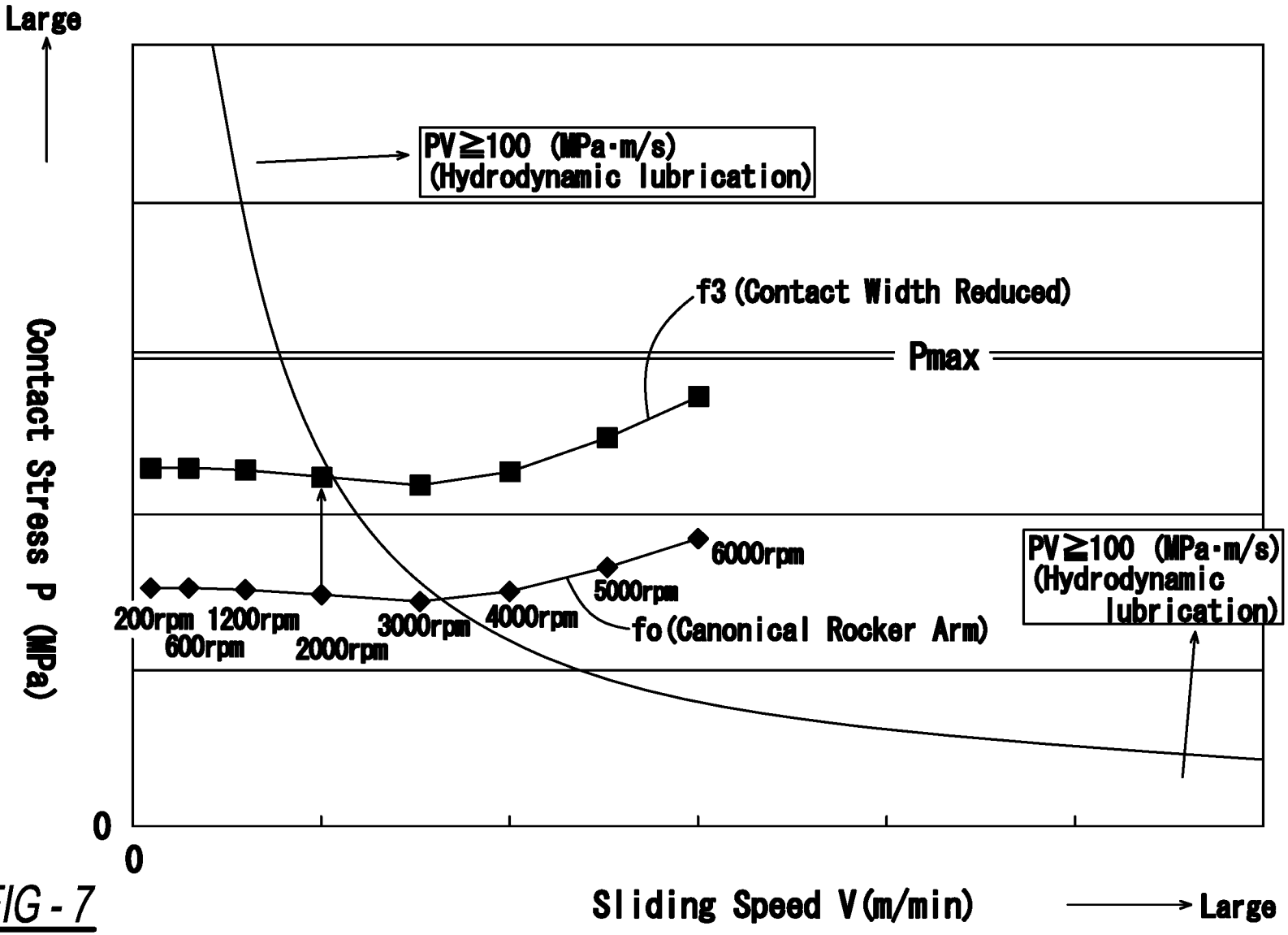
FIG. 7 compares characteristics of canonical rocker arms having a normal contact width and a reduced contact width.
Figure 8:
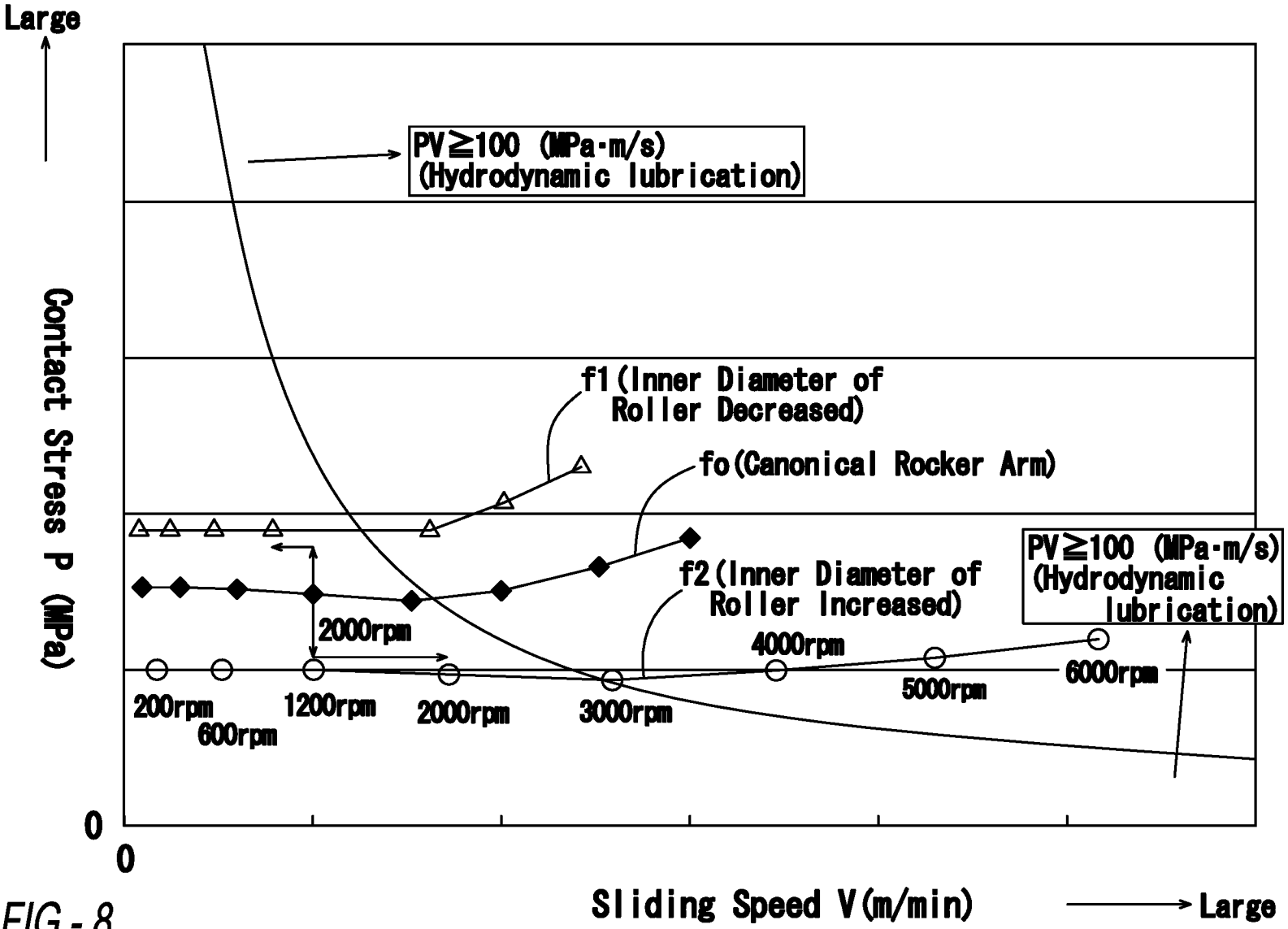
FIG. 8 compares characteristics of canonical rocker arms having a reduced inner roller diameter and an increased inner roller diameter.
Figure 9:
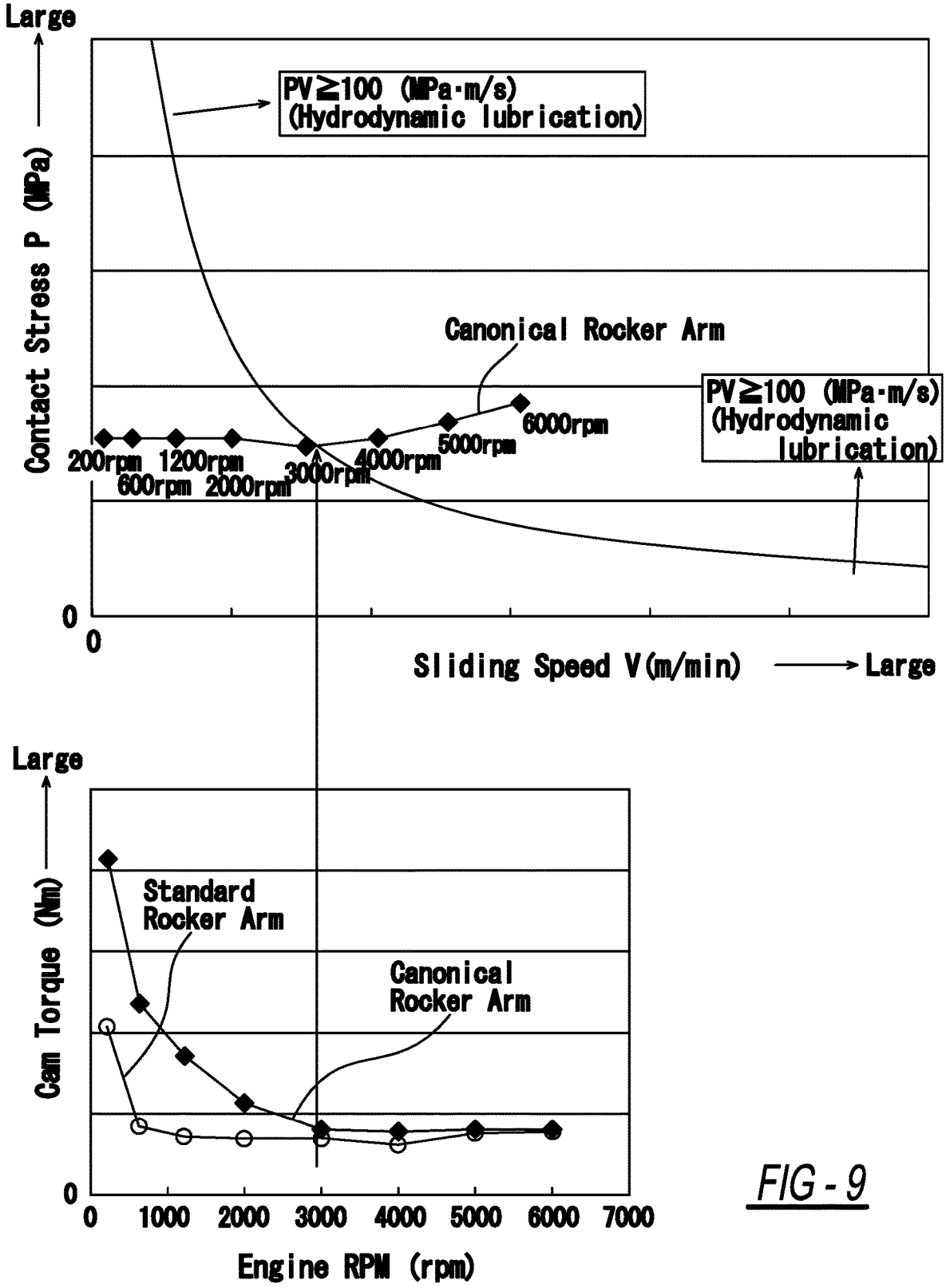
FIG. 9 compares cam torques of a canonical rocker arm and a standard rocker arm equipped with needle bearings as functions of engine rpm in all range of rpm.
Figure 10:
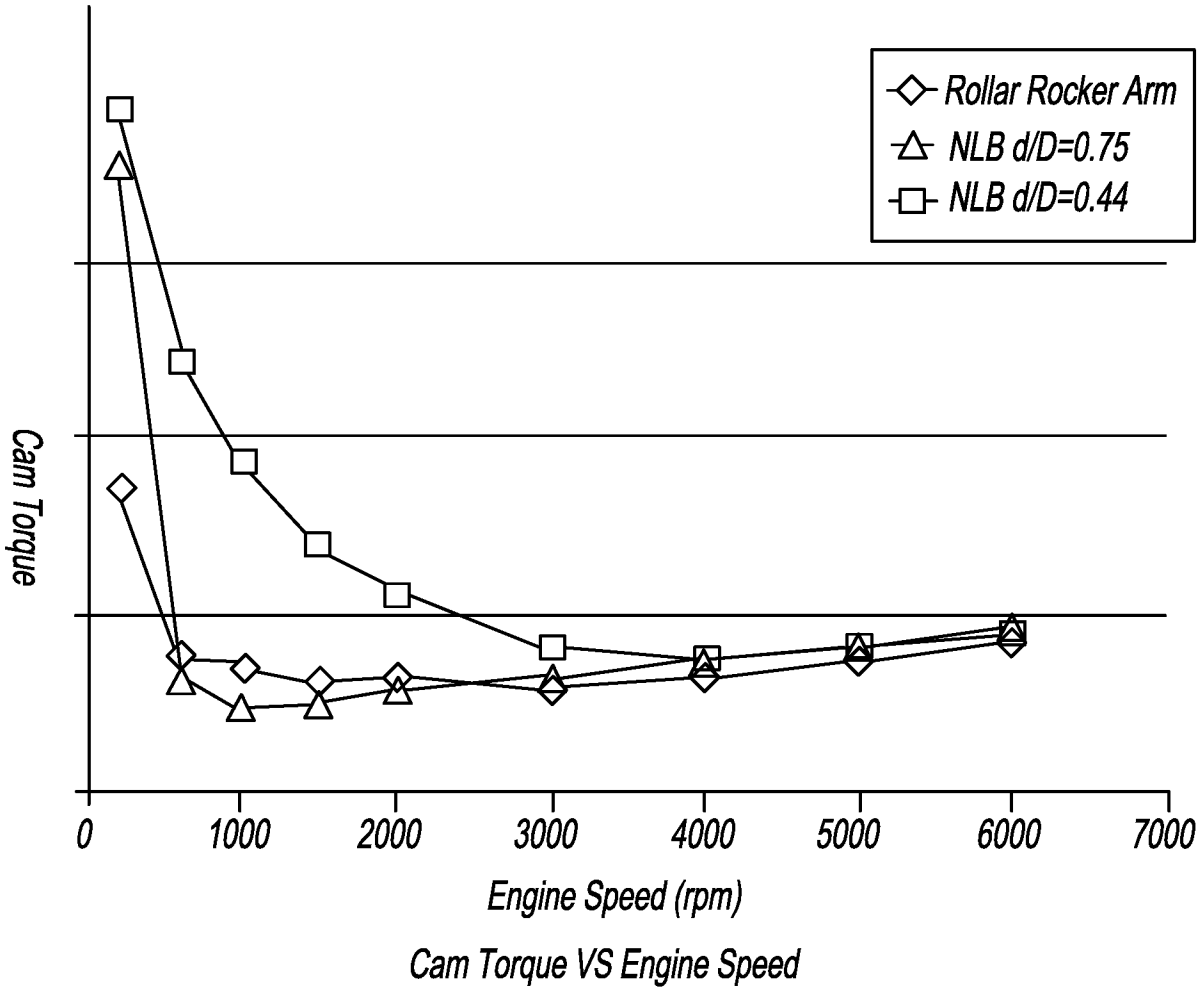
FIG. 10 is a diagram comparing cam torques involved in a standard rocker arm equipped with needle bearings, a canonical rocker arm (with d/D=0.44), and a rocker arm embodying the disclosure (d/D=0.75) in all rpm domains in regard to the second example of the disclosure.

Below the examples of the present disclosure are explained in details based on the drawings. The first example of the present disclosure is explained in reference to FIGS. 1 through 9. In order to achieve the first object of the disclosure above, in reference to FIGS. 1 through 3, a rocker arm structure for use with a valve mechanism of an engine includes an arm (4) for transmitting, to an action transmitting end of the arm (the end referred to as action transmitting end), an acting force that acts on a valve (2) to open/close the valve (2). A support shaft (5) projects laterally from the arm (4) at a position offset from said one end towards the other end of the arm (4). An annular roller (6) is rotatably mounted on the outer periphery of the support shaft (5). The roller is rotated by a cam force exerted by a cam (C) onto an outer periphery thereof to transmit the cam force to the support shaft (5) so as to transmit the cam force to said action transmitting end via the arm (4) (as shown in FIGS. 1 through 3).

A contact width Wm (defined to be the axial width of the outer periphery of the support shaft (5) in contact with the inner periphery of the roller (6)) and the inner diameter (DRin) of the roller are configured such that a product PV remains in a domain of hydrodynamic lubrication when the rpm of the engine is less than a predetermined middle level, where P is the contact stress exerted by the inner periphery of the roller (6) to the outer periphery of the support shaft (5) in contact with the roller, and V is the sliding speed V of the inner periphery of the roller relative to the outer periphery of the support shaft (5). It is noted that the contact stress P depends on the contact width Wm, while the sliding speed V depends on the inner diameter (DRin) of the roller. (Refer to FIGS. 4 through 6).

It is noted that in FIGS. 1 through 6, reference numeral 2*a* indicates a valve stem; 5*b* an outer periphery of a support shaft; 6*i* an inner periphery of a roller; 6*im* a central portion of the inner periphery of the roller; 7 a portion of opposing paired upright walls (of the arm (4)); 8 a valve-pressing portion; 9 a lush adjuster support; 9*a* a semi-spherical recess; 10 a lush adjuster; B axial length of the roller 6; and DRout outer diameter of the roller.

In order to achieve the second object of the disclosure above the manufacturing method of the rocker arm according to the example is the following.

A method of manufacturing a rocker arm structure of an engine that comprises: an arm (4) for transmitting an acting force to one end thereof (said end hereinafter referred to as action transmitting end) adapted to transmit the action to a valve (2) in order to open/close the valve (2); a support shaft (5) projecting laterally from the arm (4) at a position of the arm offset from said action transmitting end towards the other end of the arm (4); and an annular roller (6) rotatably mounted on the outer periphery of the support shaft (5), the roller rotated by a cam force exerted by a cam (C) onto an outer periphery thereof to transmit the cam force to the support shaft (5) so as to transmit the cam force to said action transmitting end via the arm (4), The method comprises configuring a contact width Wm of the outer periphery of the support shaft (5) in contact with the inner periphery of the roller (6) and the inner diameter (DRin) of the roller such that a product PV remains in a domain of hydrodynamic lubrication when the rpm of the engine is less than a predetermined middle level, where P is the contact stress exerted by the inner periphery of the roller (6) to the outer periphery of the support shaft (5) in contact with the roller, and V is the sliding speed V of the inner periphery of the roller relative to the outer periphery of the support shaft (5), whereas the contact stress P depends on the contact width Wm, while the sliding speed V depends on the inner diameter (DRin) of the roller.

According to the rocker arm of the example, in view of the fact that the contact stress (P) exerted by the inner periphery of the roller (6) to the outer periphery of the support shaft (5) in rotation at a given rpm (FIG. 7) is related to the axial width (Wm) of the outer periphery of the support shaft (5) in contact with the inner periphery of the roller (6) and that the speed (V) of the inner periphery of the roller (6) sliding relative to the outer periphery of the support shaft (5) at a given rpm (FIG. 8) is related to the inner diameter (DRin) of the roller (6), the contact width (Wm) and the inner diameter (DRin) of the roller are set such that the product (PV) remains in a domain of hydrodynamic lubrication even when the rpm of the engine is less than a predetermined middle level, where P is the contact stress exerted by the inner periphery of the roller (6) to the outer periphery of the support shaft (5) in contact with the roller (6), and V is the sliding speed of the inner periphery of the roller (6). Thus, when the rocker arm structure (3) is operated under a condition that engine oil is sprayed or showered onto the valve mechanism, engine oil enters spaces between the support shaft (5) and the roller (6). As a result, friction between the support shaft (5) and the roller (6) takes place in a domain of hydrodynamic lubrication if the engine rpm is not less than the above mentioned predetermined rpm level. Then, utilizing the inventive rocker arm (3), the cam torque can be better confirmed to the cam torque experienced in a conventional rocker arm structure that utilizes needle bearings, even when the engine rpm is in a low or middle rpm domains. (See a diagram shown in the lower half of FIG. 5.)

According to the manufacturing method of the rocker arm of the example, the above rocker arm can be manufactured by setting the axial contact width (Wm) of the outer periphery of the support shaft (5) in contact with the inner periphery of the roller (6) and setting the inner diameter DRin of the roller (6) such that the product (PV) of a contact stress P exerted by the inner periphery of the roller (6) to the outer periphery of the support shaft (5) in contact with the roller, and a sliding speed V of the inner periphery relative to the outer periphery of the roller (6), remains in a domain of hydrodynamic lubrication even when the rpm of the engine is less than a predetermined middle level.

Next the second example of the present disclosure is explained in reference to FIGS. 10 through 13. The example is based on the following findings of the present inventor obtained in a sequence of researches:

(1) A Stribeck curve can be obtained for each of bearing-free rollers of a rocker arm having different d/D ratio, where d is the inner diameter and D is the outer diameter of the roller rotatably but directly mounted on a support shaft (FIGS. 3 and 4), (2) Stribeck curves show that friction coefficients of the rollers decrease with the increasing ratio d/D;

(3) Given an engine rpm, Hersey Number, defined to be □□×v/p, where □□ is viscosity, v is the speed of the roller relative to the shaft, and p is a load per unit area, increases with the increasing ratio d/D.

(4) As shown in any of Stribeck curves, the roller can achieve a friction coefficient as large as that of a standard rocker arm (having needle bearings) even in a low rpm domain, provided that the ratio d/D is not less than a predetermined value.

Figure 11:
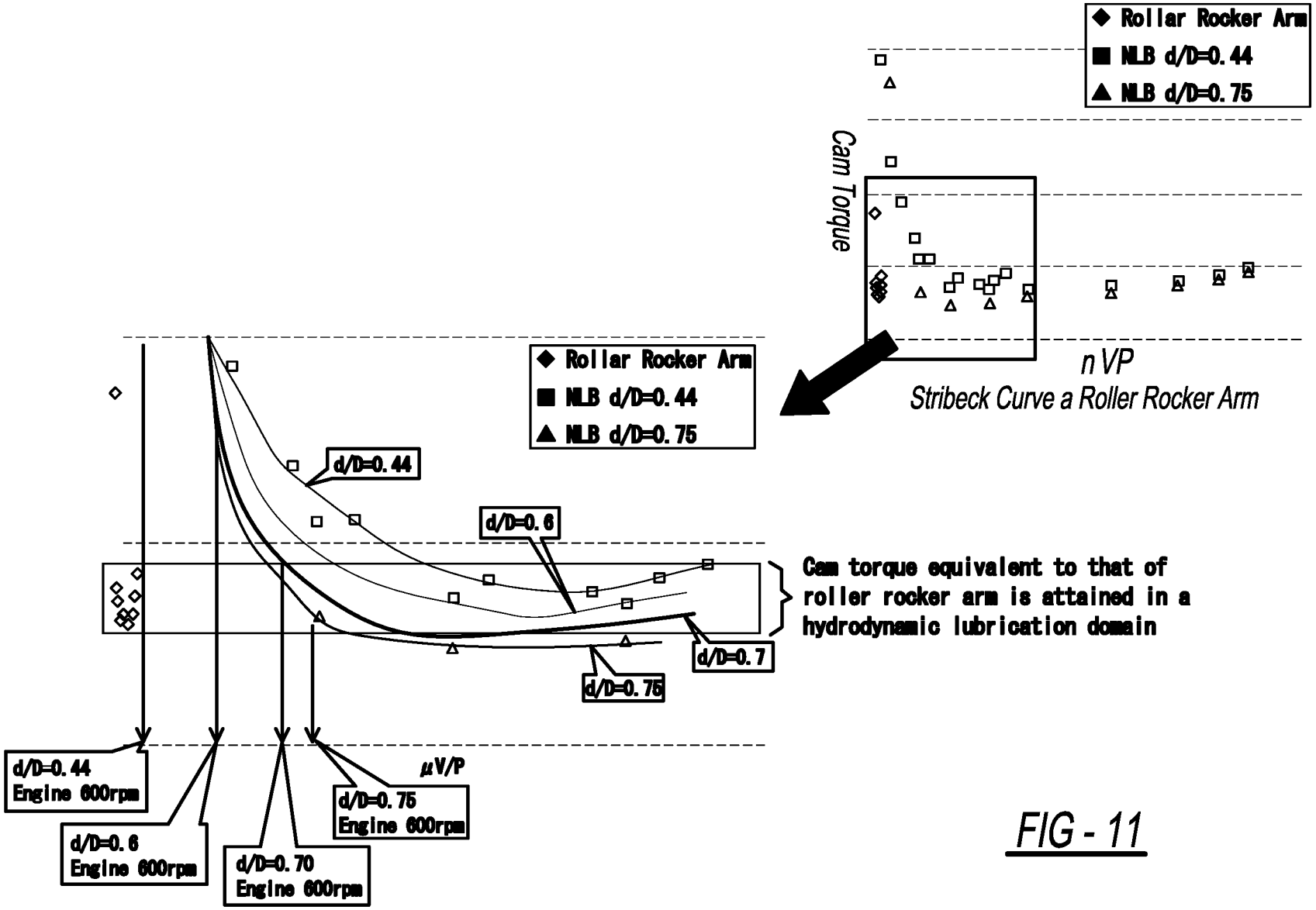
FIG. 11 shows Stribeck curves for the respective rocker arms.

From FIG. 11 sufficiently small cam torque equivalent to a roller rocker arm (acting force transmission device) having a needle bearing with engine speed of 600 rpm can be obtained when ratio d/D of an inner diameter d to an outer diameter D of the roller is not less than 0.7.

The example is achieved on the basis of the findings above. Thus, it is an object of the example to provide an acting force transmission device for use with a valve mechanism, the acting force transmission device comprising an acting force transmission member for transmitting the acting force to a valve to open/close the valve. A support shaft mounted on the acting force transmission member. An annular roller is directly mounted on the outer periphery of the support shaft. The roller is adapted to rotate when subjected to a cam force exerted by a cam onto an outer periphery of the annular roller to transmit the cam force to the acting force transmission member as the acting force. The acting force transmission device has friction performance close to that of a conventional acting force transmission device equipped with needle bearings as much as possible even in a low and a middle rpm domain.

Further object of the example is to provide a method of manufacturing the inventive acting force transmission device mentioned above.

Figure 12:
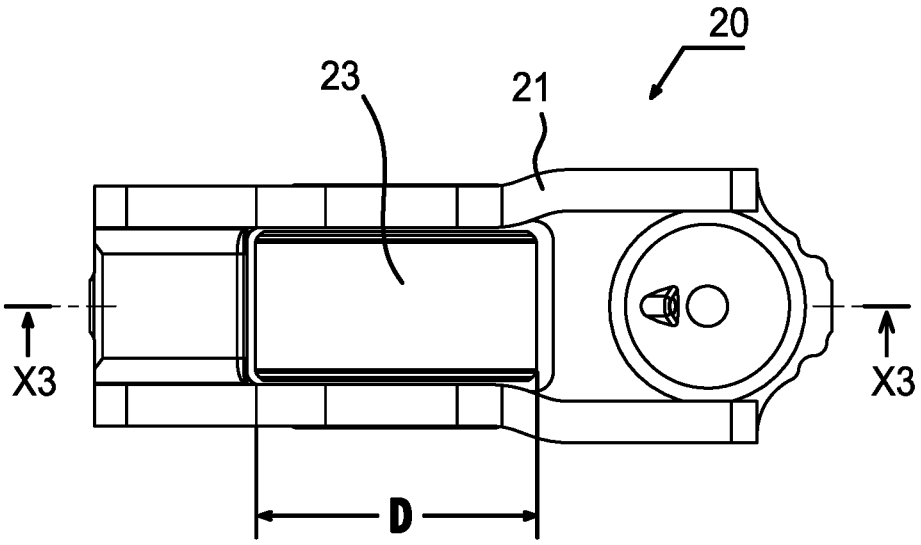
FIG. 12 is a plan view of a acting force transmission device in the form of a rocker arm in regard to the second example of the disclosure.
Figure 13:
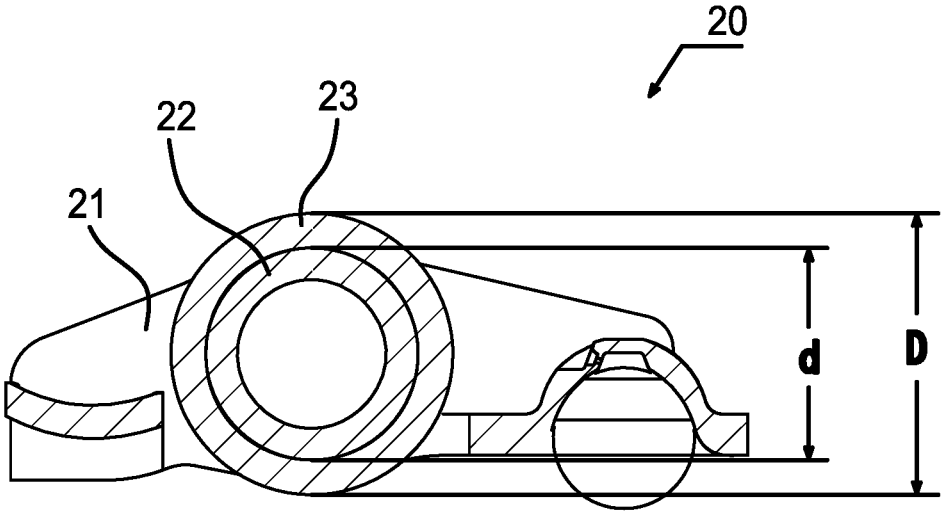
FIG. 13 is a cross section of the acting force transmission device taken along line X4-X4 in FIG. 12.

In order to achieve the above object, in reference to FIGS. 12 through 13, there is provided in accordance another aspect of the disclosure a method of manufacturing an acting force transmission device 20 (rocker arm) that comprises: an acting force transmission member 21 for transmitting an acting force to a valve to open/close the valve; a support shaft 22 mounted on the acting force transmission member 21; and an annular roller 23 directly mounted on the outer periphery of the support shaft 22, the roller 23 adapted to rotate when subjected to a cam force exerted by a cam onto the outer periphery thereof to transmit the cam force to the acting force transmission member 21.

The method includes a step of configuring the roller 23 to have an inner diameter d and an outer diameter D such that the ratio d/D of d to D is not less than 0.7. The upper limit of the ratio d/D can appropriately be configured with dimensions, strength, etc. required for each part considered, about 0.95 for example.

The manufacturing method of the acting force transmission device for use with valve mechanism according to the example is structured as following.

The acting force transmission device 20 comprises an acting force transmission member 21 for transmitting an acting force to a valve to open/close the valve. A support shaft 22 is mounted on the acting force transmission member 21. An annular roller 23 is directly mounted on an outer periphery of the support shaft 22 and adapted to rotate when subjected to a cam force exerted by a cam and adapted to transmit the cam force to the acting force transmission member 21 as the acting force, The method comprises a step of configuring the roller 23 such that a ratio d/D of an inner diameter d to an outer diameter D of the roller 23 is not less than 0.7.

According to the acting force transmission for use with valve mechanism 20 of the example, it is possible to realize lubrication between the inner periphery of the roller 23 and the outer periphery of the support shaft 22 near a domain of elastohydrodynamic lubrication (EHL) even at a low rpm (600 rpm for example) if the ratio d/D of the inner diameter d to the outer diameter D of the inventive roller is set to not less than 0.7 in accord with the inventor's findings, so that the inventive acting force transmission device achieves nearly the same friction performance as a conventional device equipped with needle bearings even under a middle/low engine rpm domain (FIG. 11).

According to the manufacturing method of the acting force transmission for use with valve mechanism 20 of the example, it is possible to have lubrication between the inner periphery of the roller 23 and the outer periphery of the support shaft 22 take place in a domain close to elastohydrodynamic lubrication (EHL) by setting the ratio d/D of the inner diameter d and outer diameter D of the inventive roller 23 to not less than 0.7 even under a middle/low engine rpm domain (600 rpm for example).

The foregoing description has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A rocker arm structure for use with a valve mechanism of an engine, the rocker arm structure comprising:

a rocker arm for transmitting an acting force to a valve to open/close the valve;

a support shaft mounted on the rocker arm; and an annular roller directly mounted on an outer periphery of the support shaft, the annular roller adapted to rotate when subjected to a cam force exerted by a cam and adapted to transmit the cam force to the rocker arm as the acting force, wherein a ratio d/D of an inner diameter d to an outer diameter D of the annular roller is not less than 0.7.

2. The rocker arm structure of claim 1 wherein the annular roller comprises an inner periphery that opposes the outer periphery of the support shaft.

3. The rocker arm structure of claim 1 wherein lubrication is realized between an inner periphery of the annular roller and an outer periphery of the support shaft near a domain of elastohydrodynamic lubrication.

4. The rocker arm structure of claim 3 wherein the lubrication is realized at an engine revolution per minute of 600 rpm.

5. The rocker arm structure of claim 1 wherein the ratio d/D is 0.95.

6. The rocker arm structure of claim 1, wherein the rocker arm includes a first end configured to engage the valve, and a second end pivotably mounted about a lash adjuster.

7. The rocker arm structure of claim 1, wherein a first portion of the inner periphery is angled towards the outer diameter of the annular roller such that only a second portion of the inner periphery is in contact with the outer periphery of the support shaft.

8. The rocker arm structure of claim 1, wherein a hydrodynamic lubrication is realized between the inner periphery of the annular roller and the outer periphery of the support shaft.

9. The rocker arm structure of claim 1, wherein a near elastohydrodynamic lubrication is realized between the inner periphery of the annular roller and the outer periphery of the support shaft.

10. A method of manufacturing a rocker arm structure for use with a valve mechanism of an engine, the rocker arm structure comprising:

a rocker arm for transmitting an acting force to a valve to open/close the valve;

a support shaft mounted on the rocker arm; and an annular roller directly mounted on an outer periphery of the support shaft and adapted to rotate when subjected to a cam force exerted by a cam and adapted to transmit the cam force to the rocker arm as the acting force;

wherein the method comprises a step of configuring the annular roller such that a ratio d/D of an inner diameter d to an outer diameter D of the annular roller is not less than 0.7.

11. The method of claim 10, further comprising:

directly and rotatably mounting the annular roller onto the support shaft.

12. A rocker arm structure for use with a valve mechanism of an engine, comprising:

an arm for transmitting an acting force to an action transmitting end thereof and adapted to transmit the action to a valve in order to open/close the valve;

a support shaft projecting laterally from the arm at a position of the arm offset from the action transmitting end toward an opposite end of the arm; and an annular roller rotatably mounted on an outer periphery of the support shaft, the annular roller rotated by a cam force exerted by a cam onto the outer periphery thereof to transmit the cam force to the support shaft so as to transmit the cam force to said action transmitting end via the arm, whereas contact stress P depends on a contact width (Wm), while the sliding speed V depends on an inner diameter (DRin) of the annular roller, wherein the contact width Wm of the outer periphery of the support shaft in contact with an inner periphery of the annular roller and the inner diameter (DRin) of the annular roller are configured such that a product PV remains in a domain of hydrodynamic lubrication even when an rpm of the engine is at an rpm less than a predetermined middle rpm level, where P is a contact stress exerted by the inner periphery of the annular roller to the outer periphery of the support shaft in contact with the annular roller, and V is a sliding speed V of the inner periphery of the annular roller relative to the outer periphery of the support shaft.

13. The rocker arm structure of claim 12 wherein the support shaft is mounted on the arm.

14. The rocker arm structure of claim 13 wherein the support shaft is directly and rotatably mounted onto the arm.

15. The rocker arm structure of claim 14 wherein the annular roller inner periphery opposes the outer periphery of the support shaft.

16. The rocker arm structure of claim 13 wherein lubrication is realized between the inner periphery of the annular roller and the outer periphery of the support shaft near a domain of elastohydrodynamic lubrication.

17. A method of manufacturing a rocker arm structure that comprises:

an arm for transmitting, to one end thereof serving as an action transmitting end, an acting force that acts on a valve to open/close the valve;

a support shaft projecting laterally from the arm at a position offset from said one end towards an opposite end of the arm; and an annular roller rotatably mounted on an outer periphery of the support shaft, the annular roller rotated by a cam force exerted by a cam onto the outer periphery thereof to transmit the cam force to the support shaft so as to transmit the cam force to said action transmitting end via the arm;

wherein the method comprises configuring a contact width (Wm) of the outer periphery of the support shaft in contact with the inner periphery of the annular roller and an inner diameter (DRin) of the annular roller such that a product PV remains in a domain of hydrodynamic lubrication even when an rpm of the engine is at an rpm less than a predetermined middle rpm level, where P is a contact stress exerted by the inner periphery of the annular roller to the outer periphery of the support shaft in contact with the annular roller, and V is a sliding speed V of the inner periphery of the annular roller relative to the outer periphery of the support shaft.

18. The method of claim 17, further comprising:

directly and rotatably mounting the annular roller onto the support shaft.

* * * * *